US007963533B2

(12) United States Patent
Bothun et al.

(10) Patent No.: US 7,963,533 B2
(45) Date of Patent: Jun. 21, 2011

(54) ALL-TERRAIN RETAIL MERCHANDISING UNIT

(75) Inventors: Richard A. Bothun, Owatonna, MN (US); Todd Hanson, Medford, MN (US); Michael D. Jines, Northfield, MN (US); Gregg S. Nelson, Northfield, MN (US); Dan Swedberg, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 504 days.

(21) Appl. No.: 11/725,147

(22) Filed: Mar. 16, 2007

(65) Prior Publication Data

US 2007/0216120 A1 Sep. 20, 2007

Related U.S. Application Data

(63) Continuation-in-part of application No. 11/221,586, filed on Sep. 8, 2005, which is a continuation-in-part of application No. 10/990,277, filed on Nov. 16, 2004.

(60) Provisional application No. 60/783,204, filed on Mar. 16, 2006, provisional application No. 60/523,044, filed on Nov. 17, 2003, provisional application No. 60/543,047, filed on Feb. 9, 2004, provisional application No. 60/599,227, filed on Aug. 5, 2004, provisional application No. 60/616,538, filed on Oct. 6, 2004.

(51) Int. Cl.
*B62B 3/02* (2006.01)

(52) U.S. Cl. ..... 280/47.35; 211/2

(58) Field of Classification Search ..... 280/47.35, 280/47.34, 47.19, 79.2, 33.991, 47.11, 47.17, 280/124.12, 137.5, 655.1, 79.11, 79.3; 211/2, 211/151, 186

See application file for complete search history.

(56) References Cited

U.S. PATENT DOCUMENTS

| | | | | |
|---|---|---|---|---|
| 566,926 | A | 9/1896 | McKay et al. | |
| 702,503 | A | 6/1902 | Stewart | |
| 1,033,630 | A | 7/1912 | Sowers | |
| 1,981,655 | A | 11/1934 | Lucke, Jr. | |
| 2,068,403 | A | 1/1937 | Ekstrom | |
| 2,093,856 | A * | 9/1937 | Wales | 62/258 |

(Continued)

FOREIGN PATENT DOCUMENTS

DE 3242953 A1 5/1984

(Continued)

OTHER PUBLICATIONS

Rolling Storage Systems, "Rolling Storage Systems," Internet Archive Wayback Machine, http://web.archive.org/web/20010421235451/http://rollingstoragesystems.com/, Apr. 21, 2001, 1 page.

Rolling Storage Systems, "Rolling Storage Systems-Product Description," Internet Archive Wayback Machine, http://web.archive.org/web/20030724174314/rollingstoragesystems.com/newDescriptionPage1.htm, Jul. 24, 2003, 2 pages.

Rolling Storage Systems, "Description, Innovative Storage for the Garage and Basement," Internet Archive Wayback Machine, http://web.archive.org/web/20010503150402/rollingstoragesystems.com/NewDescriptionPage2.h..., May 3, 2001, 1 page.

(Continued)

*Primary Examiner* — John D Walters

(74) *Attorney, Agent, or Firm* — Patterson Thuente Christensen Pedersen, P.A.

(57) ABSTRACT

An all-terrain retail merchandising unit or kiosk that can be used outdoors and across grass and gravel for outdoor events. The all-terrain retail merchandising unit can include a chassis, pneumatic tires, and steering that can provide the all-terrain retail merchandising unit with mobility across grass, gravel, and any other uneven or non-flat surfaces. The all-terrain retail merchandising unit can be used inside facilities, moved across a campus, shifted from place-to-place during indoor or outdoor events, and loaded on trucks or trailers for away events.

25 Claims, 8 Drawing Sheets

U.S. PATENT DOCUMENTS 2,166,704 A 7/1939 Foulkes
2,336,686 A 12/1943 Hudash
2,772,639 A 12/1956 Ingold
2,904,383 A 7/1959 Potts
2,915,195 A 12/1959 Crosby
2,987,200 A 6/1961 Ingold
3,044,577 A 7/1962 Lotz
3,080,204 A 3/1963 Lindhgren
3,188,977 A 6/1965 Viktorsson
3,198,592 A 8/1965 Zippel
3,286,651 A 11/1966 Dahl, Jr.
3,410,223 A 11/1968 Miller
3,427,085 A 2/1969 Staller
3,540,614 A 11/1970 Flagg
3,563,180 A 2/1971 Rutledge
3,563,400 A 2/1971 Greaves
3,566,802 A 3/1971 Lundgvist
3,575,479 A 4/1971 Kombuchen
3,620,564 A * 11/1971 Wenger et al. ..... 296/83
3,640,595 A 2/1972 Staller
3,724,389 A 4/1973 Greaves
3,772,994 A 11/1973 Juarbe
3,801,176 A 4/1974 Higbee
3,829,189 A 8/1974 Staller
3,861,702 A 1/1975 Wilson
3,865,446 A 2/1975 Mastronardi
3,890,903 A 6/1975 Showell
3,893,589 A * 7/1975 Mandell ..... 221/123
3,923,354 A 12/1975 Young
3,944,309 A 3/1976 Taniwaki
3,957,323 A 5/1976 Tucker
3,967,868 A 7/1976 Baker, Jr.
3,981,511 A 9/1976 Foster
4,017,131 A 4/1977 Camenisch
4,033,649 A 7/1977 Naito
4,084,125 A 4/1978 King
4,084,867 A 4/1978 Putt et al.
4,087,020 A * 5/1978 Krakauer ..... 221/84
4,256,355 A 3/1981 Yamaguchi
4,307,922 A 12/1981 Rhodes, Jr.
4,326,465 A 4/1982 Forrest
4,372,514 A 2/1983 Glumac
4,412,772 A 11/1983 Naito
4,417,524 A 11/1983 Quinn
4,421,365 A 12/1983 Taniwaki
4,422,816 A 12/1983 Naito
4,432,589 A 2/1984 Sattel
4,441,617 A 4/1984 Forsberg
4,450,968 A 5/1984 Muellner
4,462,500 A 7/1984 Konstant
4,467,924 A 8/1984 Morcheles
4,523,794 A 6/1985 Peterman
4,557,534 A 12/1985 Dahnert
4,597,615 A 7/1986 Steger
4,669,790 A * 6/1987 Briggs ..... 312/223.3
4,802,622 A 2/1989 Homan
4,807,765 A 2/1989 Brown
4,941,578 A 7/1990 Devening
4,974,500 A * 12/1990 Boyd et al. ..... 99/279
4,991,725 A 2/1991 Welsch et al.
5,072,838 A 12/1991 Price, Jr. et al.
5,160,189 A 11/1992 Johnston
5,190,302 A * 3/1993 Trotta ..... 280/35
5,348,324 A * 9/1994 Trotta ..... 280/35
5,439,281 A 8/1995 Croker
5,526,916 A 6/1996 Amdahl et al.
5,597,217 A 1/1997 Hoska et al.
5,634,649 A * 6/1997 Breining et al. ..... 280/47.35
5,651,469 A 7/1997 Lodge
5,676,428 A 10/1997 St. Laurent
5,680,942 A 10/1997 McAllister
5,683,155 A 11/1997 Samo
5,718,398 A 2/1998 Ross, Jr.
D393,553 S 4/1998 Beggs
6,027,190 A 2/2000 Stewart
6,102,496 A * 8/2000 Parham ..... 312/138.1
6,112,917 A 9/2000 Baker
6,152,043 A 11/2000 Haring
6,161,485 A 12/2000 Muth
6,173,458 B1 * 1/2001 Maddux ..... 4/626
6,231,138 B1 5/2001 Janson
6,241,106 B1 6/2001 Fujita
6,247,769 B1 6/2001 Spitzer
6,371,031 B1 4/2002 Muth
6,460,950 B2 10/2002 Spitzer
6,533,372 B1 * 3/2003 McCrossin et al. ..... 312/140.4
6,592,189 B1 7/2003 Back, Sr.
6,634,668 B2 10/2003 Urffer, III
6,644,213 B2 11/2003 Muth
6,669,314 B1 12/2003 Nemec
6,688,708 B1 2/2004 Janson
6,752,281 B1 * 6/2004 Mason et al. ..... 211/195
6,792,935 B2 * 9/2004 Williams et al. ..... 126/41 R
6,796,319 B1 * 9/2004 Patarra et al. ..... 135/16
6,824,231 B2 11/2004 Jakob-Bamberg et al.
6,948,785 B1 9/2005 Frank
7,124,902 B1 10/2006 Chen
7,284,393 B1 * 10/2007 Macmillan ..... 62/457.7
7,464,785 B2 * 12/2008 Spark ..... 180/236
2004/0000774 A1 1/2004 Zeuner
2005/0057011 A1 * 3/2005 Chang ..... 280/47.35
2005/0132924 A1 6/2005 Bothun et al.
2005/0144858 A1 7/2005 Bothun et al.
2005/0150178 A1 7/2005 Bothun et al.
2005/0236340 A1 10/2005 Bothum et al.
2006/0076306 A1 4/2006 Bothun et al.
2006/0163184 A1 7/2006 Parker et al.
2006/0231517 A1 10/2006 Bothun et al.

FOREIGN PATENT DOCUMENTS

GB 2 225 928 A 6/1990
WO WO 9530569 A1 * 11/1995

OTHER PUBLICATIONS

Rolling Storage Systems, "Description, Innovative Storage for the Garage and Basement," Internet Archive Wayback Machine, http://web.archive.org/web/20010507061616/rollingstoragesystems.com/NewDescriptionPage3.htm, May 7, 2001, 2 pages.
Rolling Storage Systems, "Rolling Storage Systems-Features," Internet Archive Wayback Machine, http://web.archive.org/web/20010428112116/rollingstoragesystems.com/NewFea..., Apr. 28, 2001, 1 page.
Rolling Storage Systems, "Ordering Information," Internet Archive Wayback Machine, http://web.archive.org/web/20030724174450/rollingstoragesystems.com/NewOrdering.htm, Jul. 24, 2003, 2 pages.
Rolling Storage Systems, "Rolling Storage Systems-Pricing," Internet Archive Wayback Machine, http://web.archive.org/web/20010503032347/rollingstoragesystems.com/PricingMatrix.htm, May 3, 2001, 2 pages.
Rolling Storage Systems, "Rolling Storage Systems-About Us," Internet Archive Wayback Machine, http://web.archive.org/web/20010428111359/rollingstoragesystems.com/New A..., Apr. 28, 2001, 1 page.
MC 2 Retail Merchandising Unit "Traditional Pushcart," undated, http://www.cartandkiosk.com/mc2.html, 1 sheet.
MC3 3'×6" Retail Merchandising Unit, undated, http://www.cartandkiosk.com/mc3.html, 1 sheet.
MC4 4'×4' Retail Merchandising Unit, undated, http://www.cardandkiosk.com/MC4.html, 2 sheets.
MC8 Retail Merchandising Unit, undated, http://www.cartandkiosk.com/MC8.html, 1 sheet.
Foundation Unit, undated, http://www.cartandkiosk.com/foundation.html, 2 sheets.
Mini-Merchandiser Cart Series, undated, http://www.cartandkiosk.com/mini/mini.htm, 2 sheets.
Case Study, Spacesaver Corporation, SC 9889, Aug. 1998, 2 pages.
Case Study, Spacesaver Corporation, SC 9889A, Aug. 1998, 1 page.
Spacesaver Corporation Advertisement, undated, 1 page.

* cited by examiner

ALL-TERRAIN RETAIL MERCHANDISING UNIT

RELATED APPLICATION

This application claims the benefit of U.S. Provisional Application No. 60/783,204, entitled "MOBILE RETAIL MERCHANDISING UNIT," filed Mar. 16, 2006, and is a continuation-in Part of U.S. patent application Ser. No. 11/221,586 filed Sep. 8, 2005, entitled "MODULAR STORAGE SYSTEM FOR RETAIL MERCHANDISING UNITS" which is a continuation-in-part of application Ser. No. 10/990,277 filed Nov. 16, 2004, entitled "MODULAR STORAGE SYSTEM FOR LOGISTICAL MANAGEMENT OF OPERATIONAL UNITS," which claims priority to U.S. Provisional Application No. 60/523,044, entitled "LOGISTICAL MANAGEMENT OF FIELD EQUIPMENT FOR OPERATIONAL UNITS" filed Nov. 17, 2003, U.S. Provisional Application No. 60/543,047, entitled "LOGISTICAL MANAGEMENT OF FIELD EQUIPMENT FOR OPERATIONAL UNITS" filed Feb. 9, 2004, U.S. Provisional Application No. 60/599,227, entitled "LOGISTICAL MANAGEMENT OF FIELD EQUIPMENT FOR OPERATIONAL UNITS" filed Aug. 5, 2004, and U.S. Provisional Application No. 60/616,538, entitled "LOGISTICAL MANAGEMENT OF FIELD EQUIPMENT FOR OPERATIONAL UNITS" filed Oct. 6, 2004, all of which are incorporated herein by reference in their entirety.

FIELD OF THE INVENTION

The present invention relates generally to merchandising units. More particularly, the present invention relates to a mobile retail unit or kiosk.

BACKGROUND OF THE INVENTION

Retailers often use retail merchandising units or kiosks from which to display and sell merchandise. Such merchandise can include clothes, accessories, mobile phones and accessories, food and beverages, school-related products such as shirts, hats, shorts, banners, buttons, pom-poms, noisemakers, bumper stickers, and various other commodities. Conventional retail merchandising units and kiosks include both (1) stationary retail merchandising units and (2) modular retail merchandising units.

Stationary retail merchandising units can generally be moved only with a number of persons and/or the aid of a lifting device. The lack of mobility can inhibit using the stationary units at different locations. For example, if a retailer desires to sell merchandise at high-impact sales and outdoor events, such as sporting events including baseball games, track and field and cross-country events, and football games, parades, carnivals, festivals, and other such events, an indoor stationary unit would not be easily movable to the outdoor venue.

While modular retail merchandising units can generally be moved from location to location, they are not movable outdoors across grass, gravel, and any other unpaved, uneven or non-flat surfaces for outdoor events. As such, the modular units are generally not easily usable at outdoor events, such as sporting events, parades, festivals, work-related events, school events, or for any outdoor vending purpose.

Because the general problems discussed above have not been addressed by conventional retail merchandising units, there is a current need for an improved modular retail merchandising unit.

SUMMARY OF THE INVENTION

The all-terrain retail merchandising unit or kiosk (ATK) of the present invention overcomes the deficiencies of conventional kiosks by providing a unit that can be used outdoors and readily transported across grass, gravel, and any other unpaved, uneven or non-flat surfaces commonly found at outdoor events. The ATK can comprise a chassis, wheels having pneumatic tires, and steering that can provide the ATK with the mobility across these surfaces.

The ATK can broadly comprise a body presented on a chassis, pneumatic or inflatable tires, and a steering mechanism that can provide the ATK with mobility across grass, gravel, and any other uneven or non-flat surfaces. In general, the ATK can be used inside facilities, moved across terrain, shifted from place-to-place during indoor or outdoor events, and/or loaded on trucks or trailers for transporting to multiple events.

In one embodiment, the ATK of the present invention can include a canopy locking or slide-bolt mechanism that can be used to lock or otherwise secure the contents of the ATK when not in use.

In a further embodiment, the ATK can include a "kickstand" that can be used to provide further stability to the ATK on any surface, including grass, gravel, and any other uneven or non-flat surfaces.

In another embodiment, the ATK can include shelves for storage boxes to be used therein enabling an individual group to have its own merchandise in its own set of storage boxes and store such merchandise when not on display in the ATK.

In another aspect of the invention, the ATK can include a scrub brake, for example, such that when a drawbar of the ATK is rotated to a vertical position, the handle can push the scrub brake assembly against the two front tires, thus generally effectively "parking" the ATK in either the deployed or closed mode.

In another example embodiment, the ATK can include an electrical plug strip that can be used to provide power to any electrical equipment on or in the ATK.

BRIEF DESCRIPTION OF THE DRAWINGS

The invention may be more completely understood in consideration of the following detailed description of various embodiments of the invention in connection with the accompanying drawings, in which.

Figure 1:
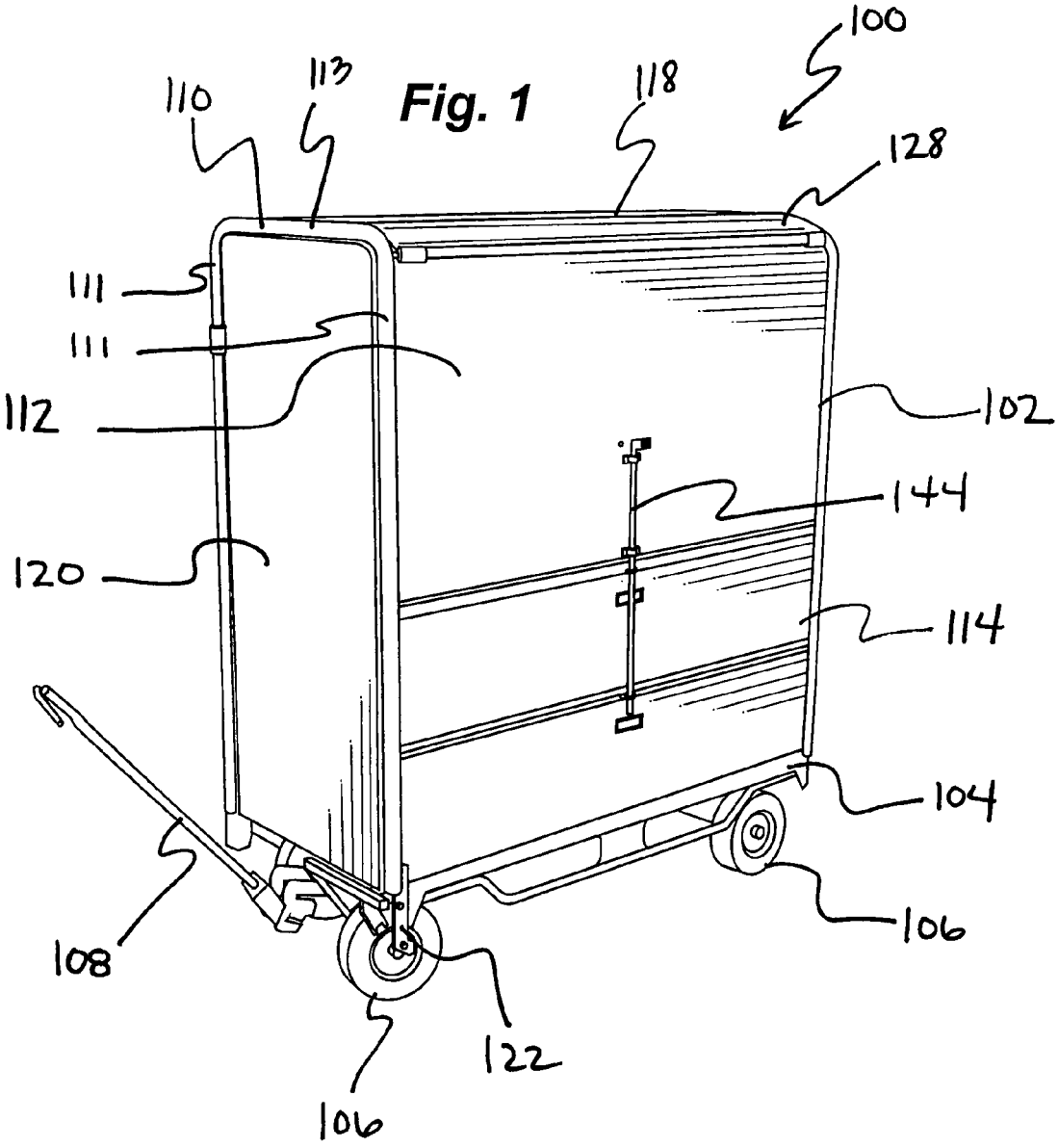
FIG. 1 is a front perspective view of an all-terrain retail merchandising unit in accordance with the present invention, wherein the ATK is depicted in a towing configuration.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives.

DETAILED DESCRIPTION OF THE DRAWINGS

In one embodiment of the invention, as depicted in FIGS. 1-8, ATK 100 generally comprises a body 102 presented on a chassis 104, at least two pneumatic or inflatable tires 106, and a steering mechanism 108. Body 102 can comprise a base 109, a frame 110 operably coupled to base 109, an optional storage structure 114, at least one rear panel 116, a top panel 118 operably coupled to frame 110 and generally opposed to base 109, a canopy 112 operably coupled to top panel 118, and first and second generally opposed end doors 120 operably coupled to frame 110.

Figure 6:
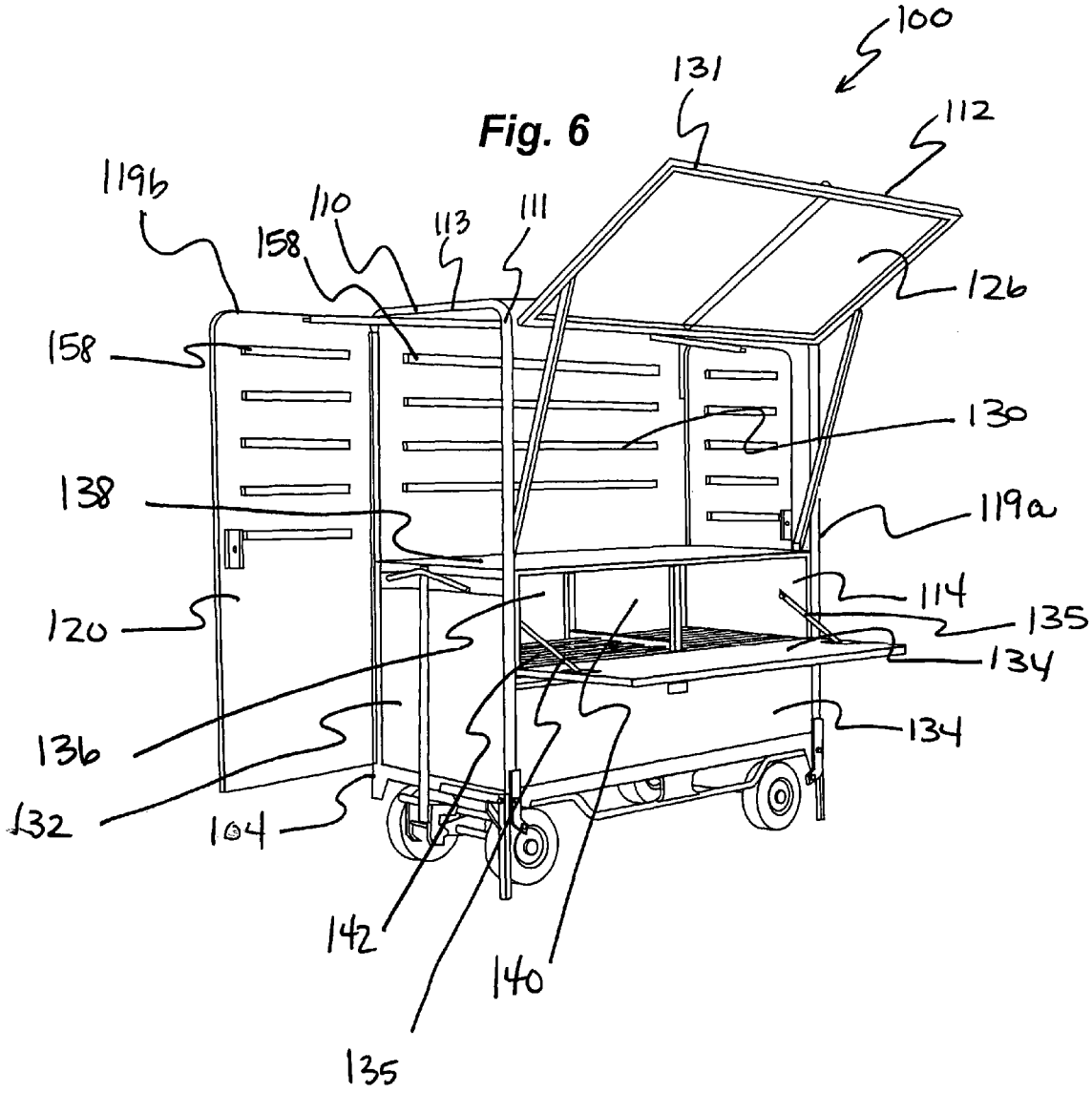
FIG. 6 is a front perspective view of the all-terrain retail merchandising unit of FIG. 5, depicting an upper bin in an open configuration.
Figure 7:
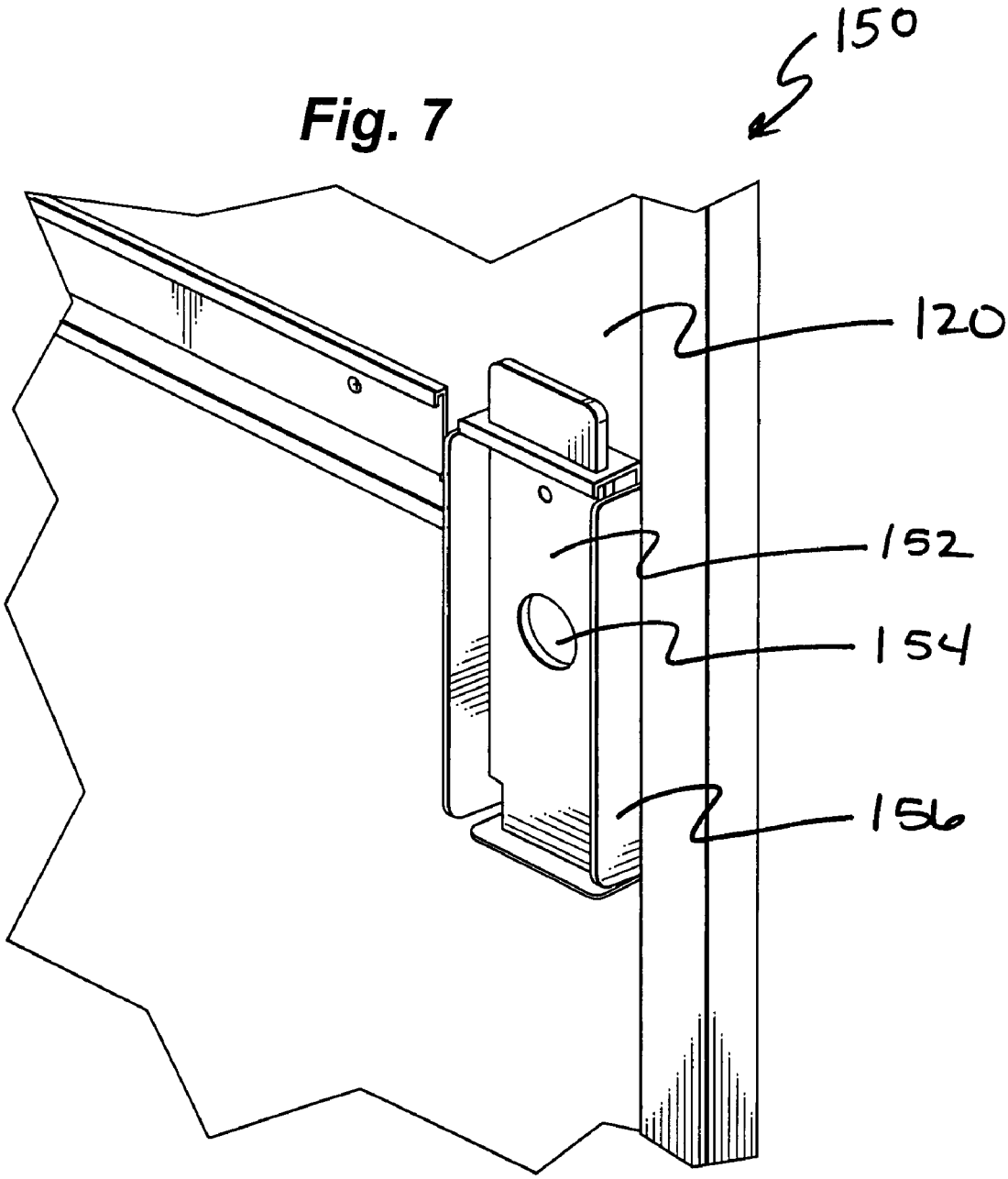
FIG. 7 is a detail view of a slide lock of end doors of the all-terrain retail merchandising unit of FIG. 1.

As depicted in FIG. 6, ATK 100 comprises a first end 119*a* and a generally opposed second end 119*b*, each end 119 comprising a frame 110 and an end door 120 fixedly, hingedly or operably coupled to frame 110 using a plurality of brackets or hinges. Frame 110 can comprise a pair of generally opposed vertical members 111 connected by a substantially horizontal frame member 113 opposite where vertical members 111 are coupled to base 109. Frame 110 can be formed as a generally inverted U shape. Horizontal frame member 113 can be either curved or squared.

While frame 110 can be generally tubular in shape, it is contemplated that frame 110 have a different shaped cross-section, such as square, rectangular, flat, or other various geometric shapes. Frames 110 can be constructed of tubular steel, although other material such as aluminum, alloys, graphite, or composite materials can be used.

Figure 3:
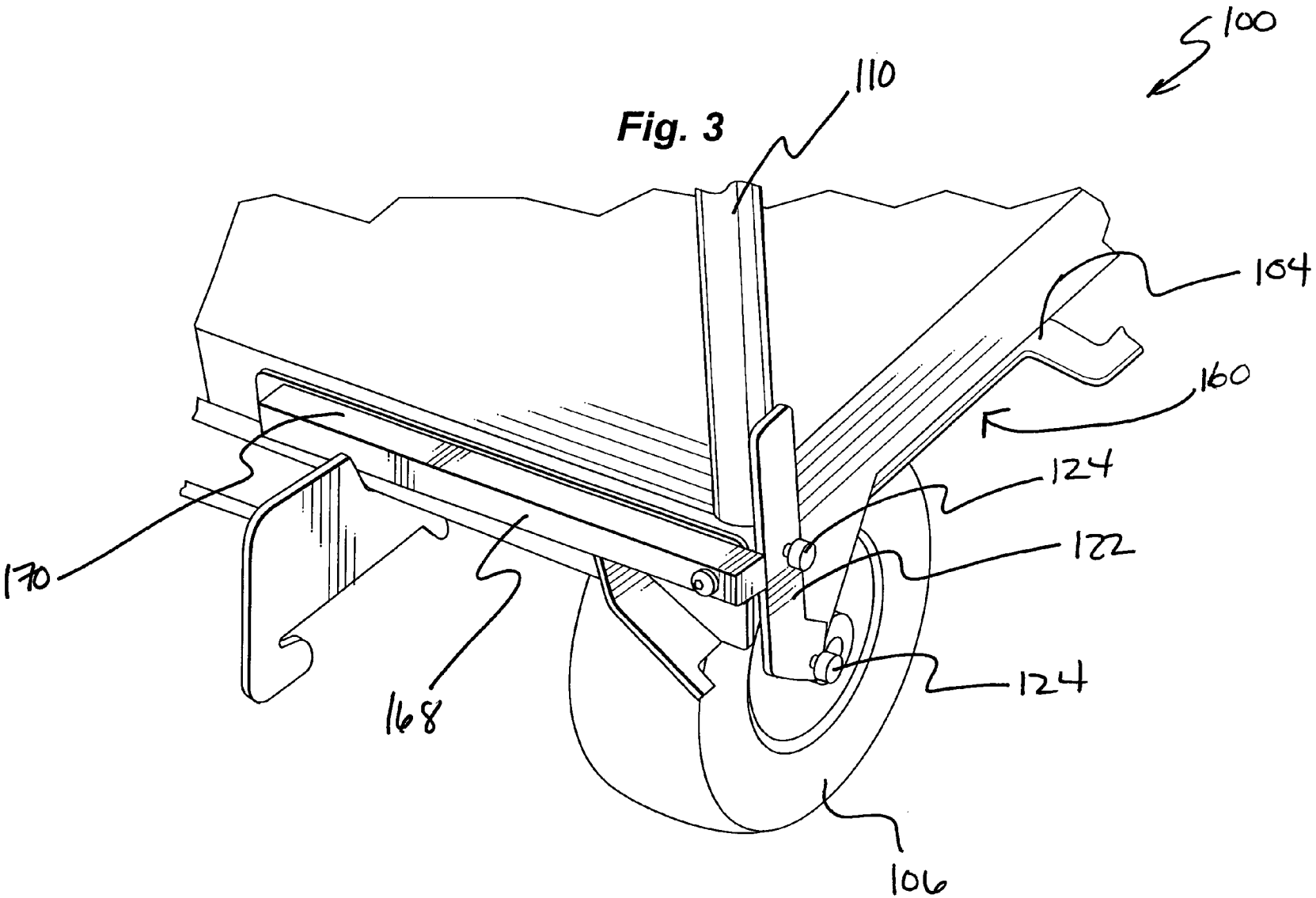
FIG. 3 is a detail view of a left front corner of the chassis of the all-terrain retail merchandising unit of FIG. 1.

Referring to FIG. 3, frame 110 is attached to connecting bracket 122 by welding, or by mechanical fasteners, such as bolts or screws. Bracket 122 is then connected to chassis 104 by mechanical fasteners 124, or by welding. Alternatively, frame 110 can be operably coupled to chassis 104 directly by welding or mechanical fastening.

Figure 4:
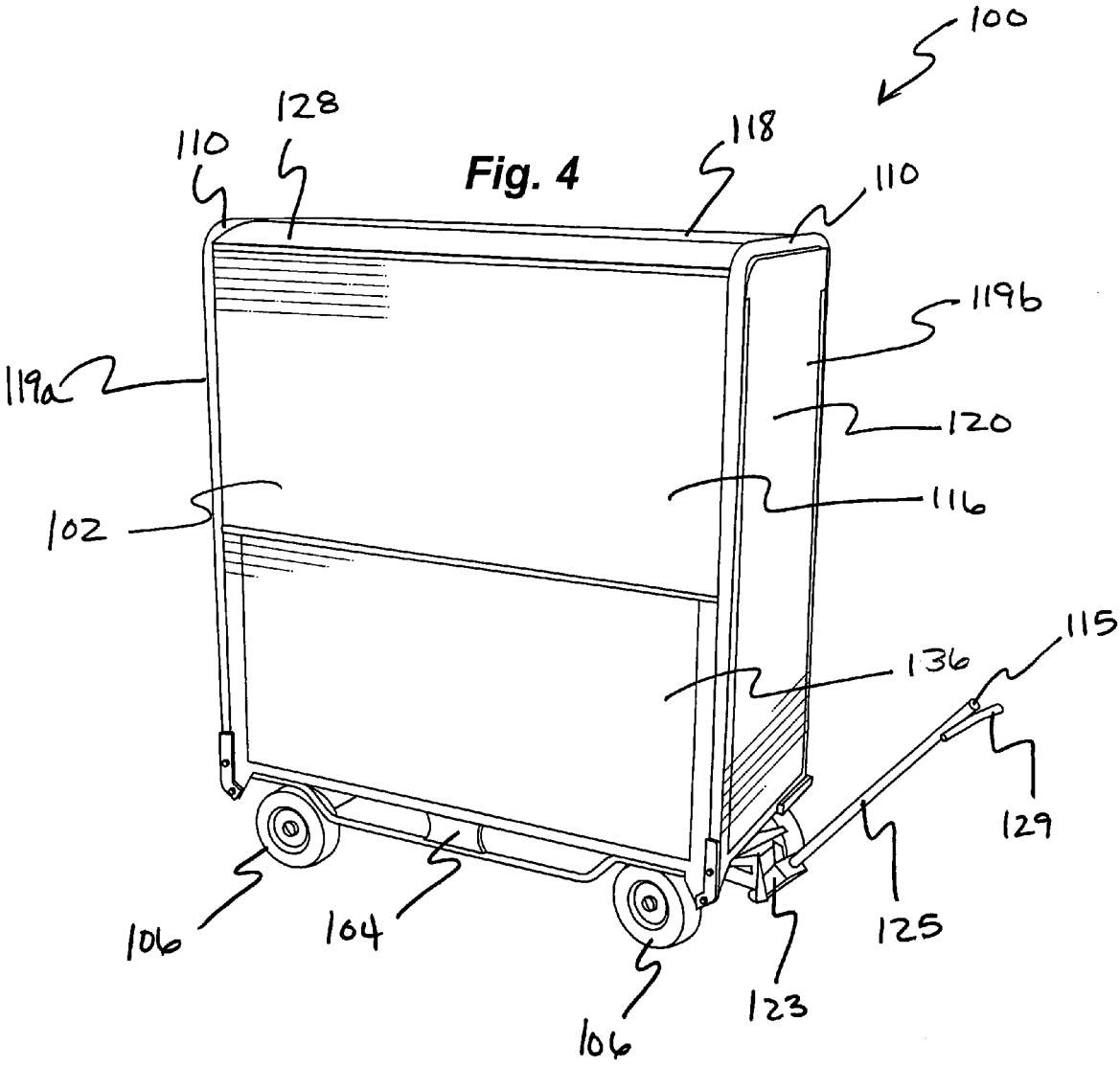
FIG. 4 is a rear perspective view of the all-terrain retail merchandising unit of FIG. 1.

As depicted in FIGS. 1 and 4, top panel 118 can extend from a frame 110 at first end 119*a* to frame 110 at second end 119*b*. Top panel 118 can also include a plurality of top panel extrusions 128 positioned on opposing sides of top panel 118 and extending substantially along the length of top panel 118. Top panel extrusions 128 can be connected to top panel 118 using, for example, a plurality of fasteners.

Referring to FIG. 6, canopy 112 can comprise a canopy panel 126 operably coupled to top panel 118 along the front edge of top panel 118. In one embodiment, as depicted in FIG. 1, canopy panel 126 can be hingedly coupled to extrusion 128. Canopy panel can further include supporting frame 131.

In other embodiments, canopy 112 can be hingedly coupled to a vertical frame member 111 of the first or second ends 119 of ATK 100, and can open towards the left or right of the unit. Alternatively, canopy 112 can also be fixedly or removably coupled to frame 110, top panel 118, top panel extrusion 128 or other portions of ATK 100 without hinges.

Canopy 112 can be constructed, for example, of a steel tubing frame with an aluminum skin. In one embodiment of the invention, canopy 112 is hingedly connected to top panel 118 along the length of extrusion 128 by for example an extruded hinge or a piano hinge. Top panel 118 is coupled to and supported by frames 110.

Canopy 112 can be closed to meet storage structure 114 to form an interior cavity 130 of ATK 100 above storage structure 114. In the open or deployed position, the interior of canopy 112 can comprise shelves, hooks, waterfalls, baskets intended for "slat wall" displays, and the like to display merchandise, food and/or beverages, and other such items. Canopy 112 can be held in its deployed position by two telescoping tube assemblies with frictional locks, such as snap button locks (not shown) or other supports.

A snap button lock (not shown) generally includes a first tube (not shown) that is free to slide within a second tube (not shown). A spring-loaded button on the first tube remains depressed while sliding within the second tube by the interior wall of the second tube. When the depressed button reaches an aperture located on the second tube, the spring-loaded button returns to its resting state within the aperture, locking the first tube at a position along the second tube. To disengage the lock, the button is manually depressed and the first tube is free to slide within the second tube.

Referring to FIG. 4, a rear view of body 102 of ATK 100 is depicted. As described above, body 102 can comprise at least one rear panel 116 coupled to and extending between frames 110. In one embodiment of the invention, as depicted in FIG. 4, body 100 comprises fixed upper panel 116*a* and lower rear panel 116*b*. Rear panel 116 can further include shelves, hooks, waterfalls, baskets intended for "slat wall" displays, and the like to display merchandise, food and/or beverages, and other such items, on the exterior side of rear panel 116, an interior side, or both. Rear panels 116 can be constructed, for example, of wood products with laminate surfaces, plastic, particle board, metal, and the like. An outer surface of rear panel 116 can also be sold as advertising space to other retailers to raise revenue in addition to the merchandise sales.

In general, ATK 100 can be operated from one side, in which a single canopy 112 faces front, with at least one fixed rear panel 116. Those skilled in the art will recognize that in other embodiments ATK 100 can be accessible on both sides. In these embodiments, canopy 112 can be positioned on both sides of ATK 100.

Figure 5:
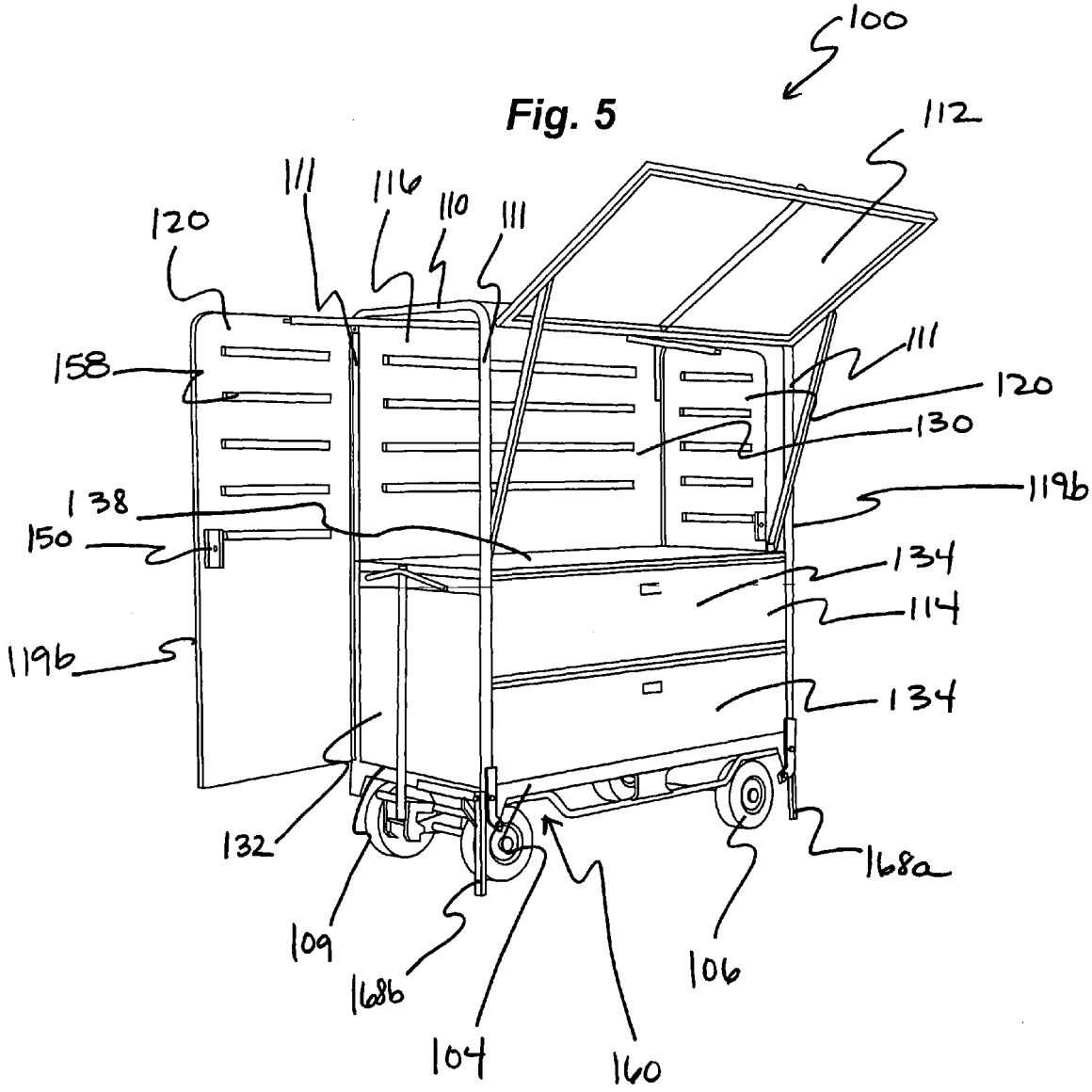
FIG. 5 is a front perspective view of the all-terrain retail merchandising unit of FIG. 1, wherein the ATK is depicted in deployed configuration.

As depicted in FIGS. 5 and 6, storage structure 114 can comprise a generally box-like structure mounted on chassis 104. Storage structure 114 generally can include two side panels 132, each side panel coupled to and extending between vertical members 111 of frames 110, base 109 substantially covering chassis 104, at least one bin door 134, a rear panel 136, and a countertop 138 to form an interior cavity 140. As illustrated in FIG. 6, storage structure 114 can further comprise at least one rack or shelf 142 to provide compartments within interior cavity 140. Storage structure 114 can optionally be heated, refrigerated, illuminated, or any combination thereof.

Rear panel 136 can be either one and the same as rear panel 116 that makes up the entire rear of body 102, or rear panel 136 can be a second lower panel, as depicted in FIG. 4. Rear panel 136 is coupled to and extends between rearward vertical members 111 of frames 110.

Bin door 134 can comprise a drawer-type bin which slides on tracks, or a hinged-cover opening with doors 134, as depicted in FIG. 6. Referring more specifically to FIG. 6, storage structure 114 comprises two hinged-cover doors 134. Upper door 134 is depicted in an open configuration. Optional storage boxes (not shown) can be used within interior cavity 140 to hold or contain merchandise not on display. For example, the following dimensions can be used: about 14" W×about 27" L×about 11" H. ATK 100 can hold or contain up to and over about eight of these boxes. For example, four boxes can be positioned behind each bin door.

In one aspect of the invention, as depicted in FIG. 6, doors 134 of bin 114 can be stopped at a horizontal position by wire stays 135 at each end. A friction device on wire stays 135 can be used to hold or retain doors 134 in an open position. Doors 134 can also be used in the open position to display merchandise.

As depicted in FIG. 5 and 6, countertop 138 can comprise a generally horizontal, planar surface. Countertop 138 is coupled to and supported by frames 110. Countertop 138 can function as a display surface, support for the contents located within ATK 100, and a cover for storage structure 114. Countertop 138 can be constructed of wood products with laminate surfaces, plastic, particle board, metal, and the like.

Storage structure 114 can be coupled to chassis 104 in a number of ways that those skilled in the art would recognize. For example, brackets (not shown) can be included such that storage structure 114 can be removably coupled to chassis 104 and operably coupled to frames 110 using the brackets. Alternatively, storage structure 114 can be welded to chassis 104, frames 110, or both.

Figure 2:
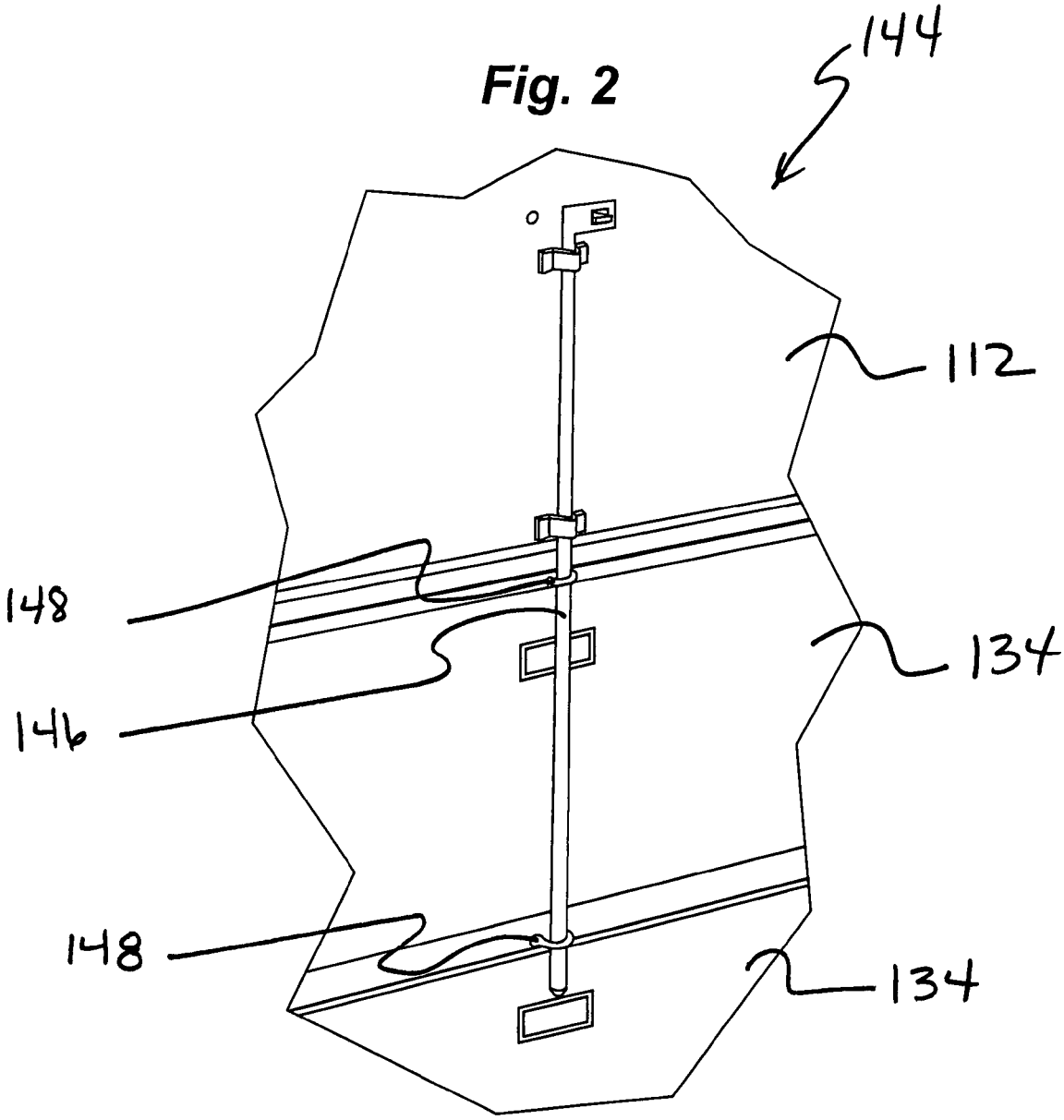
FIG. 2 is a detail view of a canopy slide-bolt of the all-terrain retail merchandising unit of FIG. 1.

Referring to FIGS. 1 and 2, ATK 100 can further comprise a canopy locking device 144, such as a canopy lock or slide bolt, padlock, or any suitable lock on canopy 112. In one embodiment, depicted in FIG. 2, locking device 144 is a canopy slide bolt that can be locked with one or more padlocks to secure the contents of ATK 100 therein when canopy 112 is in the closed position. When in the locked position, a bolt 146 can engage one or more loops 148 included on body 102, such as four metal loops 148 as depicted in FIG. 2. Loops 148 can be positioned such that one is just below countertop 138 and one is between bin doors 134, and two are on an exterior surface of canopy 112. Slide bolt 144 can be used to directly or indirectly lock canopy 112 and/or at least one bin door 134. Canopy slide-bolt 144 can comprise two positions: up/unlocked (not shown) and down/locked as depicted in FIG. 2. Those skilled in the art will recognize that the above positions can be reversed such that in the up position, canopy 112 is locked and in the down position, canopy 112 is unlocked and that other locking mechanisms can be used.

End door 120 can be positioned on first end 119*a* of ATK 100, second end 119*b*, or both. In an embodiment depicted in FIG. 5, ATK 100 includes two generally opposed end doors 120. End door 120 can be constructed, for example, of wood products with laminate surfaces, plastic, particle board, metal, and the like. End door 120 can be at least partially hinged on one side, or can be partially or completely removable. As depicted in FIG. 5, end door 120 is hingedly coupled to frame 110 at rearward vertical frame member 111.

Alternatively, end door 120 can be hingedly coupled to at least one rear panel 116. In another alternative embodiment, end door 120 can be hingedly coupled to a respective forward vertical frame member 111 such that end door 120 opens towards the front of ATK 100. In yet another alternative embodiment, end door 120 can be coupled to horizontal frame member 113 such that end door 120 opens upwardly with respect to ATK 100. End doors 120 can also be fixedly or removably coupled to frame 110 or another portion of ATK 100 without hinges.

End doors 120 can also include one or more pull handles thereon to enable opening end door 120. In other embodiments, end doors 120 can include automatic opening mechanisms, such as air lift hydraulic cylinders, that enable end doors 120 to open when released.

Similar to canopy 112 and rear panel 116, end door 120 can support shelves, hooks, waterfalls, baskets intended for slat wall displays, and the like to display merchandise, food and/or beverages, and other such items. End doors 120 can also held in open position by a telescoping tube assembly with snap buttons similar to canopy 112.

End door 120 can further comprise a locking device 150. In one embodiment, as depicted in detail in FIG. 7, locking mechanism 150 is a slide lock. Slide lock 150 on end doors 120 generally includes a captured plate 152 with a finger-hole 154 that can slide vertically in a housing 156. When end door 120 is closed, captured plate 152 can engage a portion of body 102. Housing 156 can comprise one or more flanges to inhibit unauthorized access.

End doors 120 can be locked from the inside with individual slide locks 150, and can be accessible only when canopy 112 is in the open position. Once canopy 112 is closed and locked, it can be not possible to reach in with a screwdriver, wire, or the like and unlock end door 120.

As depicted in FIGS. 5 and 6, rear panel 116 and/or end door 120 can include grooves 158 adapted for receiving hardware for displaying merchandise. Aluminum extrusions (not shown) that are insertable into slots that can generally accept any type of display hardware known to those skilled in the art. Such hardware can include hooks, waterfalls, baskets intended for "slat wall" displays. In other embodiments, T-slots can be machined into the wood panels. In an embodiment, rear panels 116 and/or end doors 120 can include one or more horizontal slots. In another aspect of the invention, rear panels 116 and/or the end doors 120 can include three or more horizontal slots spaced about six inches apart.

In a further embodiment, ATK 100 can include an electrical strip, such as an 110V plug strip. The plug strip can be mounted to a metal bracket, such that it can be located on any of the display slots.

As illustrated in FIGS. 4-6, ATK 100 can include a chassis 104 for operably connecting or mounting body 102 to at least two wheels having pneumatic tires 106 and a steering mechanism 108. Other wheels, tires and wheel tire combinations can be used. The discussion of pneumatic tires 106 herein should not be considered limiting.

In alternative embodiments, chassis 104 can be configured so ATK 100 can fit through smaller openings, which can be important for closet storage. Chassis 104 can be any suitable structure known to one of skill in the art to support body 102, and to operably connect body 102 to tires 106. In various embodiments depicted and described herein, the chassis can be constructed of welded steel. Body 102 can be permanently affixed to chassis 104 by welding or the like, or can be temporarily affixed by mechanical fastening means, such as bolts, screws, and the like. In one aspect of the invention, as depicted in FIGS. 4-6, ATK 100 comprises four tires 106, and a steering mechanism 108 operably coupled to chassis 104.

Figure 8:
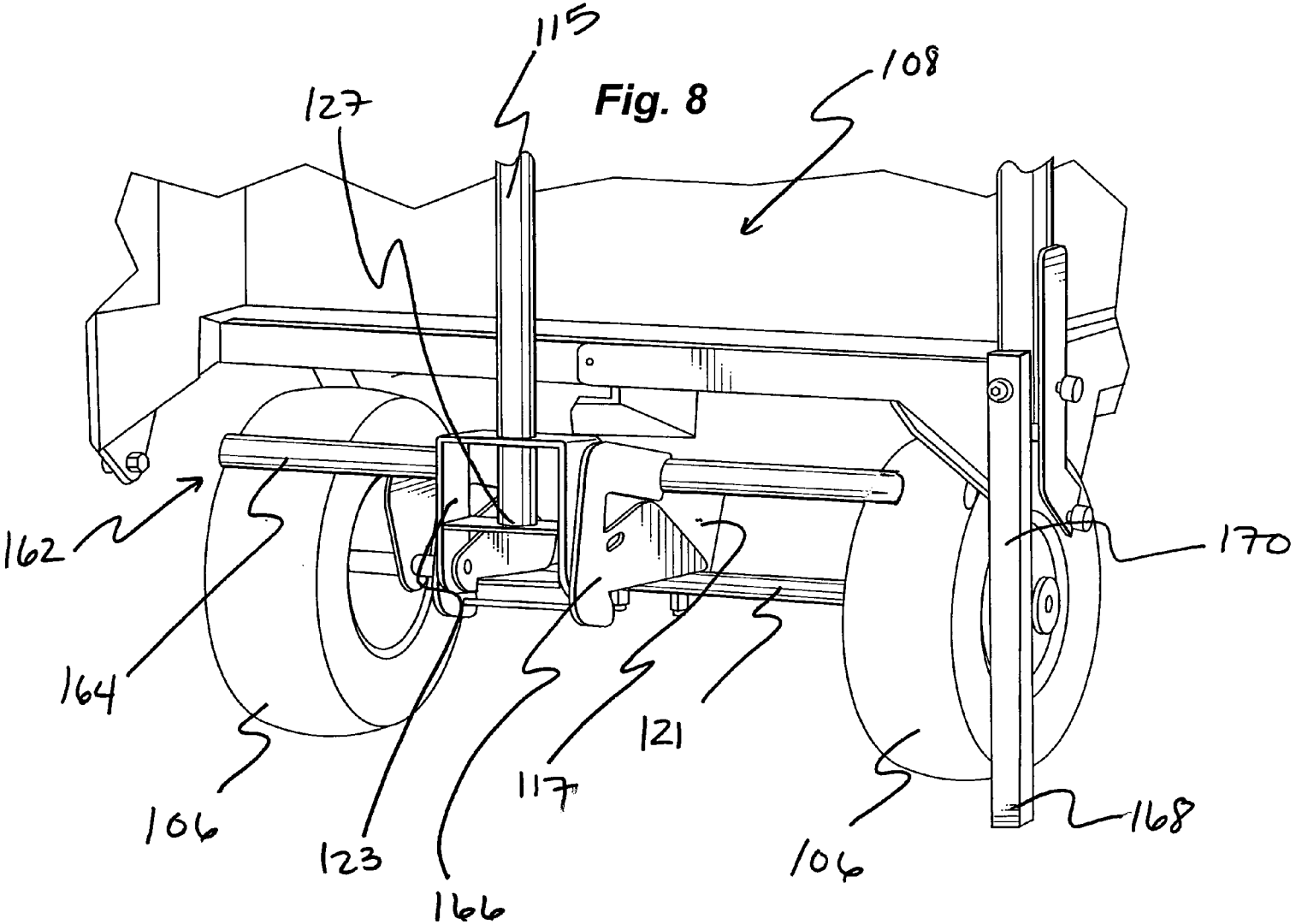
FIG. 8 is a detail view of a scrub brake and "kickstand" of the all-terrain retail merchandising unit of FIG. 1.

Referring to FIG. 8, steering mechanism 108 can comprise any suitable steering mechanism such as, for example, a "radio flyer" steering mechanism wherein front axle 121 is rotatable about a centrally located point, and other suitable steering mechanisms that can provide ATK 100 with further mobility outdoors and across grass and gravel and provides zero radius turning.

Referring to FIG. 8, steering mechanism 108 generally includes a drawbar 115 operably coupled to a steering yoke 117 by tongue 123. Tongue 123 includes an aperture for receiving a first end 127 of shaft 125 of drawbar 115 and is pivotably connected to steering yoke 117 by means of pivoting pins and the like, to enable pivoting of drawbar 115 between a substantially vertical position and a substantially horizontal position. Handle 129 is positioned proximate a second end 127 of shaft 125. Handle 129 can be substantially perpendicular to shaft 188, or angled to provide ergonomically comfortable configuration. Steering yoke 117 is further adapted to receive front axle 121.

In one embodiment of the invention, as depicted in FIG. 3, chassis 104 can be shaped to accommodate a radio flyer steering mechanism. For example, chassis 104 can comprise indentations or cut-outs 160 at each corner to provide clearance for tire 106 and/or drawbar 115 when turning.

Steering mechanism 108 can further comprise a brake assembly 162. In an example embodiment of the invention, brake assembly 162 is a scrub brake assembly, as depicted in FIG. 8. Scrub brake 162 generally comprises a horizontal tube 164 operably connected to drawbar 115 by means of an L-shaped bracket 166 and tongue 123. When drawbar 115 is in a substantially vertical position, scrub brake 162 is engaged and horizontal tube 164 is pressed against the tread of tires 106. To disengage scrub brake 162, drawbar 115 is rotated from a substantially vertical position. L-shaped bracket 166 correspondingly rotates with drawbar 115 which in turn moves horizontal tube 164 away from tires 106 until horizontal tube 164 no longer makes contact with tires 106.

A foot-release lever can also be included but is not depicted in the figures. The foot-release can comprise a rod, such as a metal rod, that can be kicked to release scrub brake 162. A brake return spring can further be included to inhibit scrub brake 162 from rubbing tires 106 during normal transport. When drawbar 115 is rotated to a vertical position, it can push scrub brake assembly 162 against two front tires 106, thus generally effectively "parking" ATK 100 in either the deployed or closed mode.

Chassis 104 of ATK 100 can further comprise at least one kickstand 168, as depicted in FIG. 3. Kickstand 168 can comprise a generally horizontal, pivotable tube 170. ATK 100 can further comprise additional kickstands 168. In one embodiment of the invention, as depicted in FIG. 5, a first kickstand 168*a* is positioned on a front corner of chassis 104, and a second kickstand 168*b* is positioned on an opposing front corner of chassis 104. While kickstand 168 as depicted is generally to be used on relatively hard surfaces, a wider base and/or an additional foot can be provided such that kickstand 168 can be used on relatively soft surfaces, such as soil, snow, mud, grass, and the like.

Kickstand 168 can be used to provide stability to ATK 100, as in some circumstances pneumatic tires 106 can generally make the kiosk less stable in the deployed position. Once ATK 100 has been parked or positioned, at least one kickstand 168 can be deployed by rotating kickstand 168 about an axis generally parallel to chassis 104. For example, kickstand 168 can be rotated 270 degrees, i.e., up, forward, and down, until kickstand 168 contacts the ground.

In operation, merchandise and the like can be stored within ATK 100 in interior cavity 130 of canopy 112 and/or interior cavity 140 of storage structure 114. Further, storage boxes can be used within canopy interior cavity 130 and/or storage compartment interior cavity 140. When using storage boxes, an individual group can have its own merchandise in its own set of storage boxes. ATK 100 can then be stocked quickly for any given event. The storage boxes can be made to any desirable dimensions.

For transporting and/or storing the contents within ATK 100, extrusion 128 is hinged on at least one side of top panel 118 so that canopy panel 126 can be in either open configuration, as illustrated in FIGS. 5 and 6, or closed configuration as illustrated in FIG. 1. In the closed position, as depicted in FIG. 1, canopy 112 can be used to conceal merchandise and the like within the interior cavity 130 of ATK 100. In addition, canopy locking device 144 can be engaged to further secure the contents within ATK 100.

End door 120, in its closed position, as depicted in FIG. 1, can further secure the contents within the interior cavity of ATK 100. On the other hand, end door 120, in its open position as depicted in FIGS. 5 and 6, can provide access to the interior of ATK 100, and can further provide additional display area.

To ensure further security, ATK 100 comprises a single canopy 112, as illustrated in the Figures. This can be generally more secure as ATK 100 can then be hosted by one person. For example, a single-side access can enable the person to keep watch on the merchandise without the concern that merchandise will be taken from the other canopy opening of ATK 100.

ATK 100 can be in towing configuration to be transported to the display location, or deployed configuration for displaying and/or storing of merchandise and the like. Referring to FIG. 1, ATK 100 is depicted in towing configuration being towed to the display location. Referring to FIG. 5, ATK 100 in a deployed configuration is depicted.

In general, to deploy ATK 100 from a closed or secure configuration to a deployed or open configuration are as follows:

(1) drop drawbar 115 to the ground;

(2) remove the padlock and raise the canopy slide bolt 144 to its unlocked position, which can enable freeing of canopy 112 and the front bin doors 134;

(3) rotate/lift canopy panel 126 to its open position;

(4) release slide lock 150 on end doors 120;

(5) raise drawbar 115 to a vertical position. This can generally require some effort, as pushing the handle vertical can engage scrub brake 162 on front tires 106*a* and 106*b*; and (6) push on the front of ATK 100 to tilt it backwards slightly and rotate kickstands 168 into place.

ATK 100 provides a readily available concession stand or kiosk that can be transported to any location. In addition, ATK 100 allows fundraising and selling merchandise in an organized and efficient way. With ATK 100, merchandise is readily available at a number of events for fundraising purposes. ATK 100 increases the efficiency and success of fundraising.

ATK 100 can be used to store and transport merchandise from a secure storage location to a location where the merchandise can be displayed and/or sold from the unit 100. Such merchandise can include school or athletic, theatric, musical, parades, pep rallies, or other various school or team-related events. School and team vendors can use ATK 100 to sell merchandise at events, such as shirts, hats, shorts, banners, buttons, pom-poms, noisemakers, bumper stickers, and the like. Using the ATK 100, vendors can arrange the merchandise in the ATK 100, close up ATK 100, move ATK 100 to the event, and simply open ATK 100 back up at the event and begin selling merchandise from ATK 100. A storage structure 114 contained in the interior of ATK 100 enables a vendor to organize the merchandise and display the merchandise in an organized manner.

Such merchandise can also include other retail merchandise at shopping centers or malls. During the night or during hours that the shopping center or mall is closed, ATK 100 can be closed up and locked and/or transported to a secure location. ATK 100 can also be taken off-site and transported between facilities or venues. During the day or during hours that the shopping center or mall is open, ATK 100 can be transported to a location where the merchandise is to be sold and then opened and unlocked.

ATK 100 can also be used as a concession stand for the storage, transport, and sale of various food and beverage items. Such concessions can include food or snacks that do not need to be cooked or prepared, including, but not limited to, candy or other non-perishable items. ATK 100 can include equipment to prepare and/or preserve other food such as stoves, grills, microwaves, refrigerators, hot plates, freezers, and other various equipment known to those of skill in the art.

ATK 100 can also be used as a newsstand or bookstand for the display and/or sale of newspapers, magazines, books, postcards, and various items that can be generally sold at newsstands.

ATK 100 according to the various embodiments is not limited to the above uses, but can be used wherever it is desired to display and/or sell items. Some other examples include, but are not limited to, automobile races, motorcycle races, ATV races, fairs, parades, arts & craft shows, auto shows, or the like. ATK 100 can also be used at various tradeshows and or school fairs, such as college fairs.

The invention may be embodied in other specific forms without departing from the essential attributes thereof; therefore, the illustrated embodiments should be considered in all respects as illustrative and not restrictive.

What is claimed is:

1. An all-terrain modular retail unit positionable within an exterior space, the all-terrain modular retail unit comprising:

a chassis having ground engaging wheels, at least one of the ground engaging wheels shiftable relative to the chassis;

two spaced-apart supporting structures, each supporting structure coupled to the chassis and having two substantially upright members extending generally upwardly from the chassis, at least one of the two supporting structures defining a first entry into an interior space defined by the chassis and the two supporting structures;

a roof structure coupled to and supported by the supporting structures, the roof structure and one of the upright members of each of the two supporting structures defining a second entry into the interior space;

a canopy operably coupled to the two supporting structures, the canopy shiftable about a hinged horizontal axis between an open canopy position wherein the interior space is in spatial communication with the exterior space via the second entry and a closed canopy position wherein the canopy substantially covers the second entry and limits accessibility to the interior space;

a door having an interior surface and an opposing exterior surface hingedly coupled to one of the upright members and pivotable about a vertical axis substantially parallel to the one of the upright members, the door shiftable between an open door position wherein the interior space is in spatial communication with the exterior space via the first entry and a closed door position wherein the door substantially covers the first entry and limits accessibility to the interior space, the interior surface of the door facing the interior space and accessible only through the second entry when the door is in the closed door position;

a canopy lock coupled to the canopy, the canopy lock operable from the exterior space to lock the canopy in the closed canopy position; and a door lock coupled to the interior surface of the door, the door lock operable to lock the door in the closed door position and inoperable from the exterior space by a user when the door is in the closed door position and the canopy is in the closed canopy position, such that the door can only be unlocked from the exterior space when the door is in the closed door position by accessing the door lock on the interior surface of the door through the second entry when the canopy lock is unlocked and the canopy is in the open canopy position.

2. The all-terrain modular retail unit of claim 1, further comprising a substantially horizontal platform substantially covering the chassis, a substantially vertical rear panel coupled to and supported by the substantially upright members, a substantially vertical side panel coupled to the supporting structures, and a front door hingedly coupled to a front edge of the substantially horizontal platform for front access into the unit.

3. The all-terrain modular retail unit of claim 1, wherein the chassis further comprises at least one kickstand.

4. The all-terrain modular retail unit of claim 1, further comprising a steering mechanism coupled to at least some of the ground engaging wheels.

5. The all-terrain modular retail unit of claim 4, wherein the steering mechanism comprises a draw bar operably connected to a steering yoke and wherein the steering yoke is operably connected to an axle connecting two ground engaging wheels.

6. The all-terrain modular retail unit of claim 4, wherein the steering mechanism further comprises further comprises a brake assembly.

7. The all-terrain modular retail unit of claim 1, wherein the ground engaging wheels comprise pneumatic tires.

8. The all-terrain modular retail unit of claim 1, wherein the all-terrain modular retail unit further comprises an electrical plug.

9. An all-terrain modular retail unit, comprising:

a chassis having ground engaging wheels and four corners including two front corners and two rear corners;

two supporting structures, each supporting structure coupled to the chassis substantially at two adjacent corners of the four corners and each supporting structure having two substantially upright members extending generally upwardly from the chassis corners;

a roof structure coupled to and supported by the supporting structures;

a canopy operably coupled to the supporting structures, the canopy being shiftable between an open position and a closed position about a hinged horizontal axis and being securable in both the open position or the closed position;

a door hingedly coupled to one of the upright members and pivotable about a vertical axis substantially aligned with one of the rear corners, the door being shiftable between an open position and a closed position and being securable in the both the open position and the closed position;

a substantially horizontal counter supported by the supporting structures above the chassis and below the roof structure;

a substantially horizontal platform substantially covering the chassis, substantially vertical rear panel coupled to and supported by the upright members extending from the rear corners;

a substantially vertical side panel coupled to the supporting structures;

a front door hingedly coupled to a front edge of the platform for front access into the unit; and a storage rack extending substantially horizontally above the platform and below the counter.

10. The all-terrain modular retail unit of claim 9, further comprising a second front door hingedly coupled to the front edge of the storage rack, wherein the first front door extends substantially vertical from the platform to the storage rack, and the second front door extends substantially vertical from the storage rack to the counter.

11. An all-terrain modular retail unit, comprising:

a chassis having ground engaging wheels and four corners including two front corners and two rear corners;

two supporting structures, each supporting structure coupled to the chassis substantially at two adjacent corners of the four corners and each supporting structure having two substantially upright members extending generally upwardly from the chassis corners;

a roof structure coupled to and supported by the supporting structures;

a canopy operably coupled to the supporting structures, the canopy being shiftable between an open position and a closed position about a hinged horizontal axis and being securable in both the open position or the closed position;

a door hingedly coupled to one of the upright members and pivotable about a vertical axis substantially aligned with one of the rear corners, the door being shiftable between an open position and a closed position and being securable in the both the open position and the closed position;

a substantially horizontal counter supported by the supporting structures above the chassis and below the roof structure; and a substantially horizontal platform substantially covering the chassis, substantially vertical rear panel coupled to and supported by the upright members extending from the rear corners;

a substantially vertical side panel coupled to the supporting structures;

a front door hingedly coupled to a front edge of the platform for front access into the unit; and a locking device adapted to secure the canopy panel and the front door in a closed position.

12. The all-terrain modular retail unit of claim 11, wherein the locking device comprises a loop positioned on a front edge of the counter, and a bolt positioned on the canopy panel and adapted to engage the loop.

13. An all-terrain modular retail unit, comprising:

a chassis having ground engaging wheels and four corners including two front corners and two rear corners;

two supporting structures, each supporting structure coupled to the chassis substantially at two adjacent corners of the four corners and each supporting structure having two substantially upright members extending generally upwardly from the chassis corners;

a roof structure coupled to and supported by the supporting structures;

a canopy operably coupled to the supporting structures, the canopy being shiftable between an open position and a closed position about a hinged horizontal axis and being securable in both the open position or the closed position;

a door hingedly coupled to one of the upright members and pivotable about a vertical axis substantially aligned with one of the rear corners, the door being shiftable between an open position and a closed position and being securable in the both the open position and the closed position; and a substantially horizontal counter supported by the supporting structures above the chassis and below the roof structure;

wherein:

the door comprises a locking mechanism; and the locking mechanism comprises a captured plate with a finger-hole that can slide vertically into a metal housing, wherein the capture plate is adapted to engage a bracket positioned on an interior of all-terrain modular retail unit.

14. An all-terrain modular retail unit, comprising:

a chassis having ground engaging wheels and four corners including two front corners and two rear corners;

two supporting structures, each supporting structure coupled to the chassis substantially at two adjacent corners of the four corners and each supporting structure having two substantially upright members extending generally upwardly from the chassis corners;

a roof structure coupled to and supported by the supporting structures;

a canopy operably coupled to the supporting structures, the canopy being shiftable between an open position and a closed position about a hinged horizontal axis and being securable in both the open position or the closed position;

a door hingedly coupled to one of the upright members and pivotable about a vertical axis substantially aligned with one of the rear corners, the door being shiftable between an open position and a closed position and being securable in the both the open position and the closed position;

a substantially horizontal counter supported by the supporting structures above the chassis and below the roof structure; and a second door hingedly coupled to another of the upright members; and pivotable about a vertical axis substantially aligned with the other rear corner, the door being shiftable between an open position and a closed position and being securable in the both the open position and the closed position.

15. The all-terrain modular retail unit of claim 14, wherein the doors support hardware for displaying merchandise.

16. An all-terrain modular unit positionable within an exterior space, the all-terrain modular unit comprising:

a chassis having ground engaging wheels, at least one of the ground engaging wheels shiftable relative to the chassis;

a body operably coupled to the chassis and defining an interior space, the body comprising:

a bottom platform extending generally horizontally to substantially cover the chassis;

a rear panel extending generally upwardly, roof structure;

a first entry into the interior space;

a second entry into the interior space;

a canopy operably coupled to the roof structure, the canopy shiftable about a hinged horizontal axis between an open canopy position wherein the interior space is in spatial communication with the exterior space via the second entry and a closed canopy position wherein the canopy substantially covers the second entry and limits accessibility to the interior space; and a door having an interior surface and an opposed exterior surface pivotable about a vertical axis substantially, the door shiftable between an open door position wherein the interior space is in spatial communication with the exterior space via the first entry and a closed door position wherein the door substantially covers the first entry and limits accessibility to the interior space, the interior surface of the door facing the interior space and accessible only through the second entry when the door is in the closed door position;

a canopy lock coupled to the canopy, the canopy lock operable from the exterior space to lock the canopy in the closed canopy position; and a door lock coupled to the interior surface of the door, the door lock operable to lock the door in the closed door position and inoperable from the exterior space by a user when the door is in the closed door position and the canopy is in the closed canopy position, such that the door can only be unlocked from the exterior space when the door is in the closed door position by accessing the door lock on the interior surface of the door through the second entry when the canopy lock is unlocked and the canopy is in the open canopy position; and a counter extending substantially horizontally within the interior cavity above the chassis and below the roof structure;

wherein a portion of an interior surface of the door and at least a portion of an interior surface of the rear panel above the counter comprise merchandise display structures, the merchandise visible when the door is in the open door position and the canopy is in the open canopy position.

17. The all-terrain modular unit of claim 16, wherein the door is oriented to be substantially coplanar with the rear panel in the open door position.

18. The all-terrain modular unit of claim 16, wherein an interior side of each of the door and the rear panel further comprise a plurality of substantially horizontal slots adapted to receive hardware for displaying merchandise.

19. The all-terrain modular unit of claim 18, wherein the hardware is selected from the group consisting of hooks, waterfall, baskets, or combinations thereof.

20. An all-terrain modular unit for storing, transporting, and displaying merchandise, the all-terrain modular unit comprising:

a chassis having ground engaging wheels and four corners including two front corners and two rear corners;

a body operably coupled to the chassis, the body defining an interior cavity created by:

a bottom platform extending generally horizontally to substantially cover the chassis;

a rear panel extending generally upwardly between the two rear corner;

a roof structure;

a canopy operably coupled to the roof structure, the canopy being shiftable between an open position and a closed position about a hinged horizontal axis substantially aligned with a front edge of the body, the canopy being securable in both the open position or the closed position; and a door pivotable about a vertical axis substantially aligned with one of the rear corners, the door being shiftable between an open position and a closed position and being securable in the both the open position and the closed position; and a counter extending substantially horizontally within the interior cavity above the chassis and below the roof structure;

wherein:

a portion of an interior surface of the door and at least a portion of an interior surface of the rear panel above the counter comprise merchandise display structures, so that the merchandise is visible when the door and the canopy are in an open position; and the body further comprises a second door pivotable about a vertical axis substantially aligned with the other of the rear corners, the door being shiftable between an open position and a closed position and being securable in the both the open position and the closed position, and wherein the second door comprises a plurality substantially horizontal slots adapted to receive hardware for displaying merchandise.

21. The all-terrain modular unit of claim 20, wherein the hardware is selected from the group consisting of hooks, waterfall, baskets, or combinations thereof.

22. A method of configuring an all terrain modular positionable within an exterior space, the all terrain retail unit having a chassis, a plurality of supporting structures, and a roof structure all defining an interior space, the method comprising:

stocking the mobile all terrain modular retail unit with merchandise;

presenting a first entry into the interior space with at least one of the two supporting structures;

presenting a second entry into the interior space with roof structure and at least one of the supporting structures;

shifting, about a hinged substantially horizontal axis, a canopy operably coupled to at least one of the supporting structures from an open canopy position wherein the interior space is in spatial communication with the exterior space via the second entry to a closed canopy position wherein the canopy substantially covers the second entry and limits accessibility to the interior space;

shifting, about a substantially vertical axis, a door having an interior surface and an opposing exterior surface hingedly coupled to one of the supporting structures from an open door position wherein the interior space is in spatial communication with the exterior space via the first entry to a closed door position wherein the door substantially covers the first entry and limits accessibility to the interior space, such that the interior surface of the door is facing the interior space and is accessible only through the second entry when the door is in the closed door position;

actuating a canopy lock coupled to the canopy to lock the canopy in the closed canopy position, the canopy lock operable from the exterior space; and actuating a door lock coupled to the interior surface of the door to lock the door in the closed door position by accessing the door lock on the interior surface of the door through the second entry when the canopy lock is unlocked and the canopy is in the open canopy position, the door lock inoperable from the exterior space by a user when the door is in the closed door position and the canopy is in the closed canopy position and only operable from the exterior space when the door is in the closed door position by accessing the door lock through the second entry when the canopy lock is unlocked and the canopy is in the open canopy position.

23. The method of claim 22, further comprising:

engaging a kickstand positioned on the chassis by rotating the kickstand from a substantially horizontal position to a substantially vertical position to contact a surface.

24. The method of claim 22, further comprising:

unlocking a bin door located below the canopy; and opening the bin door by pivoting the bin door downwardly about a horizontal axis from a generally vertical orientation to a generally horizontal orientation to provide access to an interior of a storage compartment located below the countertop.

25. The method of claim 24 further comprising:

locking the bin door in an open bin position; and displaying the merchandise on an interior surface of the bin door.

* * * * *